United States Patent [19]

Adin et al.

[11] 4,288,531

[45] Sep. 8, 1981

[54] IMAGING ELEMENTS

[75] Inventors: Anthony Adin; Richard C. Sutton; Joseph A. Verdone, all of Rochester, N.Y.

[73] Assignee: Eastman Kodak Company, Rochester, N.Y.

[21] Appl. No.: 78,865

[22] Filed: Sep. 26, 1979

Related U.S. Application Data

[63] Continuation-in-part of Ser. No. 971,300, Dec. 20, 1978, abandoned.

[51] Int. Cl.[3] ..... G03C 1/40; G03C 1/52; G03C 1/10; G03C 1/76

[52] U.S. Cl. ..... 430/338; 430/336; 430/340; 430/373; 430/374; 430/523; 430/536; 430/537; 430/539; 430/950

[58] Field of Search ..... 430/336, 338, 340, 373, 430/374, 523, 536, 537, 539, 541, 950

[56] References Cited

U.S. PATENT DOCUMENTS

| | | | |
|---|---|---|---|
| 1,762,935 | 6/1930 | Sheppard et al. | 430/536 |
| 2,732,304 | 1/1956 | Vanselow et al. | 430/512 |
| 3,102,811 | 9/1963 | Barney | 430/541 |
| 3,445,261 | 5/1969 | Talvalkar | 117/36.9 |
| 3,488,708 | 1/1970 | Smith | 430/536 |
| 3,507,678 | 4/1970 | Shimizu | 430/950 |
| 3,893,860 | 7/1975 | Sutton | 430/950 |
| 3,933,508 | 1/1976 | Ohkubo et al. | 96/950 |
| 3,939,130 | 2/1976 | Ponticello | 260/65 |
| 3,984,253 | 10/1976 | Nelson | 430/336 |
| 4,045,221 | 8/1977 | Dominh | 430/336 |
| 4,075,019 | 2/1978 | Dominh | 430/338 |
| 4,155,760 | 5/1979 | Lelental et al. | 204/2 |

OTHER PUBLICATIONS

"Overcoated Vesicular Element", Fletcher et al., *Research Disclosure* No. 16433, 2/1978.

"Transition Metal . . . Processes", Aden et al., *Research Disclosure* No. 15874, Jun. 1977, pp. 74–76.

*Primary Examiner*—Richard C. Schilling

*Attorney, Agent, or Firm*—Dana M. Schmidt

[57] ABSTRACT

An imaging element which relies upon an aromatic dialdehyde to produce a dye provides improved maximum neutral densities when certain polymers are superimposed over the element. Such polymers seal the element to reduce loss of the dialdehyde during development. An imaging method is also disclosed.

16 Claims, No Drawings

IMAGING ELEMENTS

RELATED APPLICATIONS

This application is a continuation-in-part application of U.S. Ser. No. 971,300, filed on Dec. 20, 1978, now abandoned.

FIELD OF THE INVENTION

This invention relates to an imaging element which contains an aromatic dialdehyde as a dye-forming component of a radiation-responsive image-forming composition, and a method of using such an element. More specifically, an element is provided which includes a layer of a polymer that seals the dialdehyde into the element as a means of increasing the maximum neutral densities available from the imaging element.

BACKGROUND OF THE INVENTION

Imaging elements have been devised which rely upon the photodestruction of o-phthalaldehyde which, where not destroyed, forms a dye when suitably developed. Examples are disclosed in U.S. Pat. No. 3,102,811 wherein poly(vinylpyrrolidone) and poly(vinyl alcohol) are listed as exemplary binders for an o-phthalaldehyde image-forming composition. o-Phthalaldehyde is also used as a dye-forming material in imaging elements which rely upon the reduction of cobalt(III) complexes, as described in *Research Disclosure,* Vol 158, June, 1977, Publication No 15874, published by Industrial Opportunities Ltd, Hampshire, United Kingdom.

Such imaging elements are susceptible to loss of phthalaldehyde during element formation, due to extreme volatility of the compound. Such losses can decrease drastically the amount of dye density available during development. One solution to this problem is to use as a binder for the phthalaldehyde a material which is adapted to retain the phthalaldehyde in the element during manufacturing. Particularly useful binders which provide superior levels of retention are described in commonly owned U.S. Application Ser. No. 971,464 by Fletcher et al filed on Dec. 20, 1978, entitled "Imaging Elements and Compositions Featuring Aromatic Dialdehyde-Retaining Binders."

Although the binders described in the aforesaid application greatly increase the available dye density in elements using phthalaldehyde as the dye-forming material, some phthalaldehyde can still be lost by volatilization during image processing. Losses particularly can occur when the exposed element is heated for image development. Accordingly, further retention of phthalaldehyde is desirable.

Various polymers have been used in the past as overcoats for a variety of imaging elements and for a variety of purposes. Common among such polymers are poly(vinyl pyrrolidone) and poly(vinyl alcohol) used separately, and those suggested in U.S. Pat. Nos. 3,984,253, Examples 5 and 9, and 4,075,019, layer 206 and Example 61. However, although some of these provide an increase in image densities when applied to a phthalaldehyde-imaging element, an increase greater than that obtainable with these has been sought.

SUMMARY OF THE INVENTION

In accord with the present invention, there is advantageously featured an imaging element having the capability of producing maximum neutral densities, when exposed and developed, that significantly exceed those increased neutral densities obtained using conventional overcoat materials.

Such an advantageous result is based upon the discovery that poly(acrylamide-co-N-vinyl-2-pyrrolidone-co-2-acetoacetoxyethyl methacrylate) (50:45:5), when superimposed over and sealing the imaging element, increases the available maximum neutral density considerably more than was available using conventional overcoats. Further, it was discovered that there are a substantial number of other materials that are as good as or better than this polymer.

Therefore, in accordance with one aspect of this invention, there is provided in an imaging element including a support bearing at least one layer comprising a radiation-responsive image-forming composition capable of imagewise-converting an aromatic dialdehyde into a dye, the composition including the dialdehyde, a compatible polymer composition over such layer and capable, when coated at a pH of 3.0 in an amount of about 21.5 mg/dm$^2$, dried, exposed for 0.5 second to a 400-watt medium-pressure mercury arc lamp and developed by heating for 5 seconds at 130° C. of producing with the first-mentioned layer a maximum neutral density that is at least about equal to that produced under identical conditions by the same element wherein said superimposed polymer composition consists essentially of 21.5 mg/dm$^2$ poly(acrylamide-co-N-vinyl-2-pyrrolidone-co-2-acetoacetoxyethyl methacrylate) (50:45:5). "Compatible" is used here to mean having other physical properties appropriate to an image element, e.g., sufficient adhesion to the light-sensitive underlayer, transparency to activating radiation, and freedom from cracking.

DESCRIPTION OF THE PREFERRED EMBODIMENTS

Although this invention is hereinafter described in connection with phthalaldehyde as the preferred aromatic dialdehyde, the invention is not limited thereto. Rather, it can be used advantageously with any volatile aromatic dialdehyde capable of reacting to form a dye, e.g., other aromatic dialdehydes which are dye-forming materials, for example, 4-hydroxy, 4-benzyloyloxy-, 4-methacryloyloxy-, 4-t-butyl- and 4-bromo-1,2-dicarboxaldehyde; 5,6,7,8-tetrahydro-5,5,8,8-tetramethylnaphthylene-2,3-dicarboxaldehyde; and 2,3-naphthalenedicarboxaldehyde.

Preferably, phthalaldehyde is only one component of a radiation-responsive image-forming composition containing a material for imagewise-generating a product reactable with the phthalaldehyde to form the dye. Although the preferred embodiments hereinafter disclosed feature materials for generating amines as the reaction product, the invention is not limited to such embodiments. Any composition capable of imagewise-converting phthalaldehyde to a dye can be incorporated into the imaging element of this invention.

ortho-Phthalaldehyde, herein abbreviated as phthalaldehyde, or PA, is a convenient dye-forming material capable of selective reaction with amines to form a black dye. By "amines" we refer to ammonia and primary amines. The dye reaction sequence, in the case of $NH_3$, is believed to be as follows:

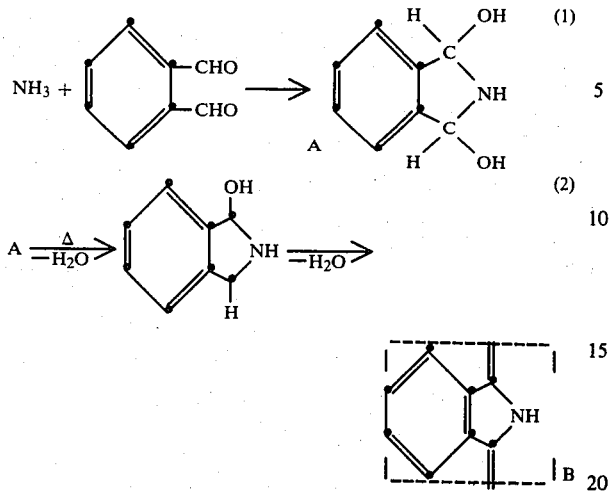

A convenient form of the invention features a layer of an image-forming composition comprising phthalaldehyde and a binder, which layer imagewise generates and responds to the presence of amines to form the oligomer dye B noted above. In accordance with one aspect of the invention, it has been discovered that, through the selection of certain polymers applied over the image-forming composition layer, improved maximum neutral density values can be obtained for dye B. As used herein, "maximum neutral density" of an element refers to the density of a point of the characteristic curve plotting developed density against the logarithm of the exposure, at which an increase in exposure produces no increase in density. With the present type of imaging element, the selection of an exposure level through a 0.15 log E step tablet which produces at least three developed steps produces a density in the most exposed step comparable with the maximum neutral density. Thus, such "most exposed" step of at least a three-step exposure is the density value referred to hereinafter as "maximum neutral density." Actual density comparisons are made at the same level of exposure in all cases.

The preferred embodiments feature such superimposed polymers as overcoats, due to the manufacturing convenience resulting therefrom. However, other methods of superposition can be used to achieve the same improvement in maximum netural densities.

Thus, overcoats of a wide variety of polymers have permitted an enhancement of the densities achieved from phthalaldehyde-containing imaging chemistries. Specifically, it has been found that, using compatible polymer compositions of this invention, the maximum neutral density values of the image-forming composition are significantly greater than when using no overcoat or a conventional overcoat polymer of other imaging elements, for example, polystyrene coated from toluene without a pH adjustment. As used herein, "significantly greater" means by an amount which is statistically significant. A polymer is said to perform about equally compared to the standard poly(acrylamide-co-N-vinyl-2-pyrrolidone-co-2-acetoacetoxyethyl methacrylate) (50:45:5), if the density increase produced thereby is about equal to the density produced by the standard.

Overcoat polymer compositions which produce with the above-described imaging composition an increased maximum neutral density value that is equal to or better than that of poly(acrylamide-co-N-vinyl-2-pyrrolidone-co-2-acetoacetoxyethyl methacrylate) (50:45:5), include gelatin, gelatin grafted with recurring units of acrylonitrile and bisacrylamidoacetic acid, and polymers or copolymers having recurring units of the formula:

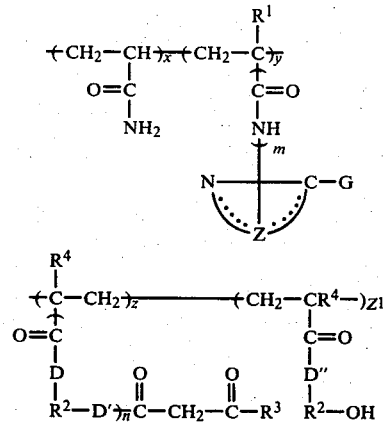

wherein:

$R^2$ is alkylene containing from 1–3 carbon atoms, such as methylene, propylene and the like;

$R^3$ is alkyl or alkoxy containing from 1–3 carbon atoms, for example, methyl, ethyl, propyl, isopropyl, methoxy, ethoxy, and the like;

$R^1$ and $R^4$ are the same or different and each is hydrogen or methyl;

G is=O or hydrogen;

m and n are the same or different and each is 1 or 0;

D, D' and D'' are the same or different and each is —NH— or —O—;

Z is the atoms necessary to complete one or more saturated or unsaturated heterocyclic rings containing from 4–9 ring atoms, such as 1-imidazole, 2-pyridine, 4-pyridine, 2-pyrrole, 2-pyrazole and the like; and x, y, z and $z^1$ are weight percents, totalling 100, of the recurring units such that:

$50 \leqq x \leqq 90$;

$10 \leqq y \leqq 50$;

$0 \leqq z \leqq 10$;

$0 \leqq z^1 \leqq 10$.

The aforenoted gelatin grafts can have recurring units with the structure:

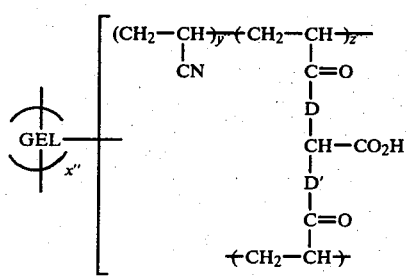

wherein:

GEL is gelatin;

D and D' are as defined above; and x'', y'', and z' are weight percents, totalling 100, of the recurring units such that:

$50 \leqq x'' \leqq 90$;

$10 \leqq y' \leqq 50$;
$0 \leqq z'' \leqq 10$.

Noninterfering recurring units other than those mentioned can be included in the copolymers useful in the invention.

The gelatin overcoats, or those having recurring units of formula (I) with pendant active methylene $$(\text{-}\overset{\overset{\displaystyle O}{\|}}{C}CH_2\overset{\overset{\displaystyle O}{\|}}{C}\text{-})$$

or primary hydroxyl groups, can be further improved for handling by crosslinking. In the case of gelatin, such crosslinking improves the toughness and water resistance of the overcoat. Useful crosslinking agents include formaldehyde and a 5 weight percent aqueous solution of hexamethoxymethyl melamine.

The superimposed composition can be a dual overcoat of two different polymers. Particularly preferred is a dual overcoat comprising 18.9 mg/dm$^2$ of poly(vinyl alcohol), hydrolyzed to at least about 99.7%, coated onto a subbing of poly(vinyl pyrrolidone) (2.7 mg/dm$^2$). The utility of such a composition is particularly surprising in light of the poor performance of poly(vinyl pyrrolidone) or poly(vinyl alcohol) of 12% acetyl content, when used separately as described below.

Preparation of the polymers of formula (I) proceeds via conventional addition polymerization techniques such as by using redox initiator systems, such as persulfate-bisulfite or hydrogen peroxide, or organic soluble free-radical-generating initiating systems such as 2,2'-azobis(2-methylpropionitrile). Similarly, the graft polymers of structure (II) are available via conventional techniques, e.g., those of U.S. Pat. No. 3,756,814, except that acrylonitrile and bisacrylamidoacetic acid in the desired proportions are substituted for the vinyl monomers having attached mordant groups according to the patent.

The following example is included by way of illustration:

Preparation of
poly(acrylamide-co-N-vinyl2-pyrrolidone-co-2-acetoacetoxyethyl methacrylate) (50:45:5)*

*As used herein, unless otherwise stated, all percentages of recurring units are weight ratios of monomers as starting materials.

To a 5-liter round-bottom flask, fitted with a stirrer, reflux condenser and nitrogen inlet, were added 3240 ml of distilled water, 360 g of denatured ethanol, 200 g (2.81 mole) of acrylamide, 180 g (1.62 mole) of vinylpyrrolidone and 20 g (0.81 mole) of 2-acetoacetoxyethyl methacrylate. The contents were purged with nitrogen for 20 min and then the flask was immersed in a 60° C. water bath. Nitrogen bubbling and stirring were continued for an additional 10 min and then 4.0 g (0.024 mole) of 2,2'-azobin(2-methylpropionitrile) dissolved in 60 ml acetone were added. The solution was stirred under nitrogen for an additional 5 hr at 60° C.

The resultant viscous polymer solution, when diluted to 5.1% solids with distilled water, had a bulk viscosity of 40 centipoise at room temperature. After dialysis, the polymer had an inherent viscosity, as measured in 1 N NaCl at 0.25 g/dl, of 1.27 at 25° C.

It is not completely understood why these polymers provide improved maximum neutral density values. Although understanding is not essential to the practice of the invention, it is believed that, in part, the overcoats of this invention are superior materials for the retention of phthalaldehyde, a volatile molecule. However, there is not an exact correspondence between best retention of phthalaldehyde and best maximum neutral density values.

The molecular weight of the polymer selected for the overcoat does not appear to be critical to the formation of improved maximum neutral density values. Furthermore, the molecular weights are subject to wide variation even within a given class of polymers, depending on the preparation conditions, as is well-known. For example, useful terpolymers of acrylamide of the type described above can have molecular weights within and beyond the range evidenced by inherent viscosities from about 0.1 to about 6.0, measured as a 0.25 weight percent solution in water, aqueous salt solutions, or mixtures of water and miscible organic solvents. A preferred range of inherent viscosities is from about 0.5 to about 2.0.

The image-forming composition preferably comprises, as noted, phthalaldehyde and a binder. The binder selected for the image-forming composition is not believed to be critical, inasmuch as even binders which are relatively pervious to phthalaldehyde can be used in such an image-forming composition if the overcoat of the invention is also used. However, the best results are achieved when using as the image-forming composition binder one of those disclosed in the aforementioned U.S. Application Ser. No. 971,464 by Fletcher et al. Particularly preferred examples of such polymers include homopolymers and copolymers such as polyacrylonitriles, e.g., poly(methacrylonitrile), and polysulfonamides such as poly[N-(4-methacryloyloxyphenylmethanesulfonamide], poly(ethylene-co-1,4-cyclohexylenedimethylene-1-methyl-2,4-benzenedisulfonamide), poly(ethylene-co-1,4-cyclohexylenedimethylene-1-chloro-2,4-benzenedisulfonamide), poly(ethylene-co-1,4-cyclohexylenedimethylene-1,2-dichloro-3,5-benzenedisulfonamide), poly(ethylene-co-1,4-cyclohexylenedimethylene-1-chloro-3,5-benzenedisulfonamide), poly(ethylene-co-1,3-xylylene-1-methyl-2,4-benzenedisulfonamide), poly(1,4-cyclohexylenedimethylene-1-methyl-2,4-benzenedisulfonamide), poly(1,3-xylylene-1-methyl-2,4-benzenedisulfonamide) and poly(ethylene-co-hexamethylene-1-methyl-2,4-benzenedisulfonamide. Of these, poly(ethylene-co-1,4-cyclohexylenedimethylene-1-methyl-2,4-benzenedisulfonamide) (50:50) is highly preferred. Preparation of the poly(acrylonitriles) proceeds via conventional processes. The above-mentioned polysulfonamides can be prepared either as condensation polymers, wherein an —$NHSO_2$— group is in the backbone of the polymer, or as addition polymers, wherein an —$NR^1SO_2$— group is a pendant moiety, $R^1$ being H or methyl. The former is made by a direct solution polycondensation reaction, preferably using aromatic disulfonyl chlorides and diamines in the presence of an acid scavenger. The latter is preferably a polymerization of vinyl monomers containing a sulfonamide pendant moiety.

It has been found that the actual amount, measured absolutely, of a given increase in maximum neutral density, will depend in part on the purity of the phthalaldehyde that is used, and specifically, on the percent of acid such as phthalic acid impurity that is present. As will be seen in the examples that follow, a significant difference in such purity will affect the absolute increase that is measured. However, it is believed that generally the relative performances of the overcoat materials, compared one to the other, are not significantly affected.

The image-forming composition also preferably includes an amine-generating material responsive to activating radiation. The amines when formed react with the phthalaldehyde to form a dye. Any amine-generating material can be used. Preferred materials for generating the amines are the cobalt(III) complexes with or without a destabilizer, as disclosed in the aforesaid Fletcher application. Examples of the complexes include those in the following Table 1. The suffix (U) designates those which are thermally unstable above about 100° C. and which therefore do not require a destabilizer.

TABLE 1

| Cobalt(III) Complexes |
|---|
| hexa-ammine cobalt(III) benzilate |
| hexa-ammine cobalt(III) thiocyanate |
| hexa-ammine cobalt(III) trifluoroacetate |
| hexa-ammine cobalt(III) hexafluorophosphate |
| hexa-ammine cobalt(III) trifluoromethane sulfonate |
| chloropenta-ammine cobalt(III) perchlorate |
| bromopenta-ammine cobalt(III) perchlorate |
| aquopenta-ammine cobalt(III) perchlorate |
| bis(methylamine) tetra-ammine cobalt(III) hexafluorophosphate |
| aquopenta(methylamine) cobalt(III) nitrate (U) |
| chloropenta(ethylamine) cobalt(III) perfluorobutyrate(U) |
| trinitrotris-ammine cobalt(III) |
| trinitrotris(methylamine) cobalt(III) (U) |
| μ-superoxodeca-ammine dicobalt(III) perchlorate (U) |
| penta-ammine carbonato cobalt(III) perchlorate |
| tris(glycinato) cobalt(III) |

A highly preferred form of the material capable of generating amines is a composition comprising a cobalt(III) complex that is thermally stable at temperatures slightly above 100° C. containing releasable amine ligands and a destabilizer which serves to initiate release of amines from the complex in response to activating radiation. Such a destabilizer compound can be a compound responsive to heat, of which the following are examples: organometallics such as ferrocene, 1,1-dimethylferrocene and tricarbonyls such as N,N-dimethylaniline chromium tricarbonyl; and organic materials such as 4-phenylcatechol, sulfonamidophenols and naphthols, pyrazolidones, ureas such as thiourea, aminimides in polymeric or simple compound form, triazoles, barbituates and the like.

Alternatively, the destabilizers can be photoactivators which respond to exposure to light to form a reducing agent for the cobalt(III) complex, whereby cobalt(II) and free amines are formed. Such photoactivators can be spectral sensitizers such as are described in *Research Disclosure,* Vol 130, Publication No 13023, the details of which are expressly incorporated herein by reference.

Preferred photoactivators are photoreductants such as metal carbonyls, e.g., benzene chromium tricarbonyl; p-ketosulfide, e.g., 2-(4-tolylthio)chromanone; disulfides; diazoanthrones; diazophenanthrones; aromatic azides; carbazides; diazosulfonates; β-ketosulfides; diketones; carboxylic acid azides; organic benzilates; dipyridinium salts; diazonaphthones; phenazines; and particularly quinone photoreductants.

The quinones which are particularly useful as photoreductants include ortho- and para-benzoquinones and ortho- and para-naphthoquinones, phenanthrenequinones and anthraquinones. The quinones may be unsubstituted or incorporate any substituent or combination of substituents which do not interfere with the conversion of the quinone to the corresponding reducing agent. A variety of such substituents are known in the art and include, but are not limited to, primary, secondary and tertiary alkyl, alkenyl and alkynyl, aryl, alkoxy, aryloxy, alkoxyalkyl, acyloxyalkyl, aryloxyalkyl, aroyloxyalkyl, aryloxyalkoxy, alkylcarbonyl, carboxy, primary and secondary amino, aminoalkyl, amidoalkyl, anilino, piperidino, pyrrolidino, morpholino, nitro, halide and other similar substituents. Such aryl substituents are preferably phenyl substituents and such alkyl, alkenyl and alkynyl substituents, whether present as sole substituents or present in combination with other atoms, typically incorporate about 20 or fewer (preferably 6 or fewer) carbon atoms.

A highly preferred class of photoreductants is that of internal hydrogen source quinones, that is, quinones incorporating labile hydrogen atoms. These quinones are more easily photoreduced than quinones which do not incorporate labile hydrogen atoms.

Particularly preferred internal hydrogen source quinones are 5,8-dihydro-1,4-naphthoquinones having at least one hydrogen atom in each of the 5- and 8-ring positions, or those which have a hydrogen atom bonded to a carbon atom to which is also bonded the oxygen atom of an oxy substituents or a nitrogen atom of an amine substituent with the further provision that the carbon-to-hydrogen bond is the third or fourth bond removed from at least one quinone carbonyl double bond. As employed in the discussion of photoreductants herein, the term "amine substituent" is inclusive of amide and imine substituents.

Further details and a list of useful quinone photoreductants of the type described above are set forth in *Research Disclosure,* Vol 126, Oct, 1974, Publication No 12617, the contents of which are hereby expressly incorporated by reference. Still others which can be used include 2-isopropoxy-3-chloro-1,4-naphthoquinone and 2-isopropoxy-1,4-anthraquinone.

The quinone photoreductants rely upon a light exposure between about 300 nm and about 700 nm to form the reducing agent which reduces the cobalt(III) complex. It is noted that heating is not needed after the light exposure to cause the redox reaction to take place. However, an additional thermal exposure can be used as part of the exposure to drive the reaction to a more timely completion. Furthermore, the heat is desirable to form the dye B.

An imaging element prepared in accordance with the invention preferably comprises the amine-generating material, phthalaldehyde and the binder all mixed together, in a single layer on the support, overcoated with a polymer of the type described. Alternatively, however, the material generating the amines in response to the radiation exposure can be associated with a separate phthalaldehyde layer. In this case, such a radiation-exposure layer comprising a cobalt(III) complex, and a destabilizer, without phthalaldehyde, can be simply applied, as by coating over the phthalaldehyde-containing layer to form an integral element. To avoid yet another overlayer, the binder for the cobalt(III) complex layer can be the overcoat of the invention as described above. However, for the best density values, it is preferred that the overcoat of the invention be applied over the cobalt complex layer.

Still another, and the currently preferred, embodiment is an element prepared by superimposing, such as by coating a second layer over the first overcoat, a polymer which can be different from the above-described polymers used in the first overcoat. Such a technique allows, e.g., the use of a more readily hardenable second overcoat which would not adhere well to the image-forming composition if coated directly. For example, poly(acrylamide-co-N-vinyl-2-pyrrolidone-co-2-hydroxyethyl acrylate (45:45:10) can be applied over gelatin as the first overcoat.

As yet another alternative, an amplifier can be included, such as phthalaldehyde, the intermediate product A of reaction (1) serving as a reducing agent for remaining cobalt(III) complexes. Or the amplifier can be a compound which will chelate with cobalt(II) to form a reducing agent for remaining cobalt(III) complexes. Such chelating compounds contain conjugated bonding systems. Typical amplifiers of this class, and necessary restrictions concerning pKa values of the anions which can be used in the cobalt(III) complex in such circumstances, are described in U.S. Pat. No. 4,075,019 issued Feb. 21, 1978, and in *Research Disclosure,* Vol 135, July, 1975, Publication No 13505, the details of which are expressly incorporated herein by reference.

In some instances, even thermally stable cobalt(III) complexes can be used without a destabilizer. Examples include compositions and elements containing the complex and a tridentate-chelate-forming amplifier, exposed to a pattern of incident electron radiation as described in *Research Disclosure,* Vol 146, Publication No 14614, June, 1976. The details of that publication are expressly incorporated herein by reference.

In commonly owned U.S. application Ser. No. 865,275 filed on Dec. 28, 1977, by Adin, entitled "Inhibition of Fogging Exposures Utilizing Cobalt(III) Complexes", there is disclosed the use of photolytically activated compositions which inhibit the reduction of cobalt(III) complexes, whereby a positive-working element can be achieved. To the extent that such photoinhibitors are generally compatible with the binders of this invention, they can also be included in the compositions and/or elements herein described.

Other layers not particularly effective in enhancing the maximum neutral density, but added for other purposes, can be disposed between the one or more overcoats described herein, and the one or more layers comprising the image-forming composition, without interfering with the function of the overcoat of this invention.

Manufacturing Techniques

To form an imaging element, the image-forming composition is preferably coated onto a support, particularly if the coating is not self-supporting. Any conventional photographic support can be used in the practice of this invention. Typical supports include transparent supports such as film supports and glass supports, as well as opaque supports such as metal and photographic paper supports. The support can be either rigid or flexible. The most common photographic supports for most applications are paper, including those with matte finishes, and transparent film supports such as poly(ethylene terephthalate) film. Suitable exemplary supports are disclosed in *Product Licensing Index,* Vol 92, Dec., 1971, Publication No 9232, at p 108, and *Research Disclosure, Vol* 134, June, 1975, Publication No 13455. The support can incorporate one or more subbing layers for the purpose of altering its surface properties so as to enhance the adhesion of the radiation-responsive composition to the support.

Supports such as poly(ethylene terephthalate) are particularly preferred because they tend to be relatively impervious at most processing temperatures to the volatile aromatic dialdehydes. As a result, phthalaldehyde is not lost through the support during the developmental heating of the exposed element. However, even supports which are not resistant to such a loss can be used, provided they are given a protective coating of one of the polymers described above for the overcoat of the element. In such a case, the result is an image-forming composition sandwiched between two protective layers, each of which comprises a polymer which results in increased maximum neutral densities.

The aforedescribed image-forming composition, and the overcoat are successively coated out of a suitable solvent onto the support. Preferably, the image-forming coating solvent is a nonaqueous solvent, such as acetone, a mixture of acetone and 2-methoxyethanol, or dimethylformamide, to permit the use of other components such as photoactivators which are soluble in nonaqueous solvents.

The proportions of the nonbinder reactants comprising the image-forming composition to be coated can vary widely, depending upon which materials are being used. Where cobalt(III) complex is present, the molar amounts for such compositions can be expressed per mole of complex. Thus, if destabilizer materials are incorporated in addition to cobalt(III) complex, they can vary widely from about 0.004 mole per mole of complex, such as ferrocene, to about 5 moles per mole for succinimide. For example, 5,5-diphenylhydantoin can be present in an amount of between about 0.1 mole and about 2 moles per mole of the complex. With respect to the phthalaldehyde, it can be present in an amount from about 1 to about 15 moles per mole of cobalt(III) complex.

A convenient range of coating coverage of phthalaldehyde is between about 2.5 and about 25 mg/dm$^2$. Conveniently, the overcoat is applied at a coverage of between about 3 and about 100 mg/dm$^2$. The total combined thicknesses of dual overcoat, if used, can be within the range noted above for a single overcoat. Preferably, such dual coverage, when using gelatin that is subsequently crosslinked, is about 20 mg/dm$^2$ with the gelatin being about 5 mg/dm$^2$.

Typically, the solutions are coated by such means as whirler coating, brushing, doctor-blade coating, hopper coating and the like. Thereafter, the solvent is evaporated. Other exemplary coating procedures are set forth in *Product Licensing Index,* Vol 92, Dec., 1971, Publication No 9232, at p 109. Addenda such as coating aids and plasticizers can be incorporated into the coating composition. A particularly useful addendum to the overcoat is one of the conventional matting agents.

EXAMPLES

The following examples further illustrate the invention. Except where noted, the phthalaldehyde tested had an amount of acid impurity that was much less than about 0.001 meq. per gm.

EXAMPLES 1–3

To demonstrate the manner in which various overcoat polymers affect the maximum neutral density available from a preferred imaging element, the following machine coating was prepared for each of the examples on a subbed poly(ethylene terephthalate) support:

| | | |
|---|---|---|
| poly(ethylene-co-1,4-cyclohexylene-dimethylene-1-methyl-2,4-benzene-disulfonamide | 75.5 | mg/dm$^2$ |
| phthalaldehyde | 25.1 | mg/dm$^2$ |
| hexa-ammine cobalt(III) trifluor-acetate | 12.5 | mg/dm$^2$ |
| 2-isopropoxy-3-chloro-1,4-naphtho-quinone | 0.36 | mg/dm$^2$ |

The overcoats, listed in Table 2, were prepared as aqueous solutions, adjusted to pH 3.0 and applied to give a dry coverage of 21.6 mg/dm$^2$. Each coating was then dried in the following order: 48 sec at about 38° C., 2 min at about 60° C., 2 min at about 70° C., 2 min at about 80° C. and 2 min at about 27° C.

After 10 days of lab keeping at approximately 24° C. and 65% RH, samples of each coating were exposed for 0.5 sec in an IBM Micromaster Diazo Copier, Model IID, to a 0.15 log E step tablet and processed for 5 sec, support side to heated surface, on a 130° C. hot block. The maximum neutral density was measured and recorded.

TABLE 2

| Example | Overcoat | Maximum Neutral Density |
|---|---|---|
| control 1 | none* | 2.3 |
| control 2 | poly(N-vinyl-2-pyrrolidone), ave. mole. wt. = 350,000, available from GAF as PVP K-90 | 2.4 |
| 1 | poly(acrylamide-co-N-vinyl-2-pyrrolidone-co-2-acetoacetoxyethyl-methacrylate) (50:45:5) | 3.2 |
| 2 | poly[acrylamide-co-N-vinyl-2-pyrrolidone-co-N-(3-acetoacetamido-propyl)methacrylamide] (50:45:5) | 3.3 |
| 3 | poly[N-(2-acetoacetoxyethyl)acrylamide-co-acrylamide-co-N-vinyl-2-pyrrolidone] (5:50:45) | 3.3 |

*This sample was not passed through the drying portion of the coating machine a second time because, although the other samples were (to dry the overcoats), an unovercoated element is used as is. A second drying of an unovercoated element would accomplish nothing useful and would reduce the available maximum neutral density.

These examples demonstrated that poly(N-vinyl-2-pyrrolidone of an ave. mole wt. of 350,000 gave a result which was not statistically significant compared with the use of no overcoat at all. On the other hand, poly(acrylamide-co-N-vinyl-2-pyrrolidone-co-2-acetoacetoxyethyl methacrylate) (50:45:5) as well as the polymer of Examples 2 and 3 demonstrated an increase in maximum neutral density of about 40% or more, compared to the control lacking any overcoat.

EXAMPLES 4–12:

The procedure of Examples 1–3 was repeated, using a different batch of overcoat polymers identified in Table 3. For comparative purposes, two other controls, a lower molecular weight poly(N-vinyl-2-pyrrolidone) and poly(vinyl alcohol) were also tested. The results of Table 3 were measured as for Examples 1–3, and further included speed results as the number of 0.15 log E steps which were fully developed to a density of greater than 1.0.

TABLE 3

| Example | Overcoat | Maximum Neutral Density | 0.15 log E Steps |
|---|---|---|---|
| Control 3 | poly(vinyl alcohol), 12% acetyl content | 2.51 | 3 |
| Control 4 | poly(N-vinyl-2-pyrrolidone), ave. mole wt. = 40,000, available from GAF as PVP K-30 | 2.62 | 3 |
| Control 5 | poly(N-vinyl-2-pyrrolidone), ave. mole wt. = 350,000, available from GAF as PVP K-90 | 2.74 | 3 |
| 4 | poly(acrylamide-co-1-vinylimidazole) (90:10) | 3.49 | 6 |
| 5 | poly(acrylamide-co-N-vinyl-2-pyrrolidone-co-2-acetoacetoxyethyl methacrylate) (50:45:5) | 3.5 | 4 |
| 6 | poly(acrylamide-co-N-vinyl-2-pyrrolidone-co-ethyl acryloylacetate) (50:45:5) | 3.56 | 5 |
| 7 | poly(acrylamide-co-N-vinyl-2-pyrrolidone-co-2-hydroxyethyl acrylate) (45:45:10) | 3.59 | 5 |
| 8 | poly(acrylamide-co-ethyl-acrylate-co-N-methyl-olacrylamide) (65:25:10) | 3.66 | 5 |
| 9 | gelatin | 3.73 | 5 |
| 10 | gelatin grafted with poly[acrylonitrile-co-bis (acrylamido)acetic acid](45:50:5) | 3.80 | 6 |
| 11 | gelatin grafted with poly[acrylonitrile-co-bis (acrylamido)acetic acid](70:25:5) | 3.82 | 6 |
| 12 | poly(acrylamide-co-N-vinyl-2-pyrrolidone) (90:10) | 3.83 | 7 |

In this series, Example 2 of Table 2 was repeated, using a new batch of polymer. However, the measured maximum neutral density was 3.04, which was discarded as erroneous in light of the fact that the only difference in the polymer from those used in Examples 5–7 was in the 5 mole % portion. Such a minor difference is not expected to vary the density results greatly, and in fact that is what is shown in the negligible variation of 3.5 to 3.59 for Examples 5–7.

The results for Example 5 are slightly higher than those of Example 1, but this is believed to be due to the fact that the phthalaldehyde had a different level of acid impurity, as discussed below. A different batch of chemicals and a different batch of polymer were used.

EXAMPLES 13–14

To demonstrate the further improvement of the invention over other conventional overcoat materials, the procedure of Example 1 was repeated except the following overcoat materials were applied:

Control 6: no overcoat

Control 7: poly(ethyl acrylate-co-acrylic acid (60:40 wt %), coated from a mixture of $H_2O$, acetone and propanol.

Control 8: poly(styrene-co-butadiene), available from Philips Petroleum under the trademark "KRO-3", coated from toluene without a pH adjustment. See Example 61 of U.S. Pat. No. 4,075,019.

Control 9: polystyrene coated from toluene without a pH adjustment. See U.S. Pat. No. 4,075,019, col. 41, line 44.

Control 10: poly(4,4'-isopropylidenediphenylene 1,1,3'-trimethyl-3-phenyl-5,4'-dicarboxylate coated from toluene without a pH adjustment. See *Research Disclosure,* Vol. 158, Pub. No. 15874, June 1977, p. 75, bottom of second column.

Control 11: poly(vinylidene chloride-co-acrylonitrile-co-acrylic acid) (79.9:14.1:6.0 wt %).

Example 13: poly(acrylamide-co-N-vinyl-2-pyrrolidone-co-2-acetoacetoxyethyl methacrylate) (50:45:5 wt %)

Example 14: poly(N-vinyl-2-pyrrolidone, 2.7 mg/dm$^2$, available from GAF Corp. under the trade name "PVP K-90", overcoated with 99.7% hydrolyzed poly(vinyl alcohol), 18.9 mg/dm$^2$.

In this series of tests, the phthalaldehyde had an acid content of 0.004 meq per gm, and the maximum neutral density values hereinafter set forth in Table 4 differed from those of the same overcoat test of previous tables for that reason. Lesser values of acid impurity would be expected to produce greater maximum neutral density values.

TABLE 4

| Example | Max. Neutral Density | 0.15 log E Steps |
|---|---|---|
| Control 6 | 1.68 | 5 |
| Control 7 | 1.85 | 3 |
| Control 8 | 2.30 | 6 |
| Control 9 | 2.45 | 6 |
| Control 10 | 2.68 | 6 |
| Control 11 | 2.85 | 6 |
| Example 13 | 2.90 | 7 |
| Example 14 | 3.25 | 7 |

The test demonstrated that none of the controls provided a maximum neutral density that was at least equal to that of Example 13.

COMPARATIVE EXAMPLES 1 AND 2

Comparative Example 1

Examples 13 was repeated, except that the overcoat was poly(acrylamide-co-N-vinyl-2-pyrrolidone) (25:75). The maximum neutral density produced was 2.76 at three 0.15 log E steps, a result that was not significantly better than Control 2 of Table 2.

Comparative Example 2

Example 1 was repeated, except that the overcoat was sodium cellulose sulfate. The maximum neutral density produced was 2.29 at three 0.15 log E steps.

Comparative Example 3

Example 13 was repeated, except that the overcoat was 5.4 mg/dm$^2$ of gelatin subsequently crosslinked that in turn was overcoated with 16.2 mg/dm$^2$ of water-soluble cellulose acetate having 17.1% acetyl content and crosslinked with hexamethoxymethyl melamine. The $D_{max}$ was 2.64, considerably less than the 2.9 value for Example 13.

The invention has been described in detail with particular reference to certain preferred embodiments thereof, but it will be understood that variations and modifications can be effected within the spirit and scope of the invention.

What is claimed is:

1. In an imaging element including a support and a radiation-responsive, image-forming composition capable of imagewise-converting an aromatic dialdehyde into a dye, said composition including said dialdehyde and comprising at least one layer on said support, the improvement comprising a compatible polymer composition superimposed over said one layer, and having recurring units of the formula

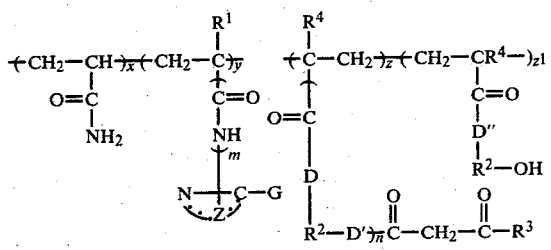

wherein $R^2$ is alkylene containing 1 to 3 carbon atoms;

$R^3$ is alkyl or alkoxy containing from 1 to 3 carbon atoms;

$R^1$ and $R^4$ are the same or different and each is hydrogen or methyl;

G is =0 or hydrogen;

m and n are the same or different and each is 1 or 0;

D, D', and D'' are the same or different and each is —NH— or —O—;

Z is the atoms necessary to complete one or more saturated or unsaturated heterocyclic rings containing from 4 to 9 ring atoms; and x, y, z and $z^1$ are weight percents, totalling 100, of the recurring units such that:

$50 \leqq x \leqq 90$, $10 \leqq y \leqq 50$, $0 \leqq z \leqq 10$, $0 \leqq z^1 \leqq 10$, said composition being capable when coated at a pH of 3.0 in an amount of about 21.5 mg/dm$^2$, dried, exposed for 0.5 second to a 400-watt medium-pressure mercury arc lamp and developed by heating for 5 seconds at 130° C., of producing with said one layer a maximum neutral density that is at least equal to that produced under identical conditions by the same element wherein said superimposed polymer composition consists essentially of poly(acrylamide-co-N-vinyl-2-pyrrolidone-co-2-acetoacetoxyethylmethacrylate) (50:45:5) at about 21.5 mg/dm$^2$.

2. An element as defined in claim 1, wherein said compatible polymer composition comprises poly[a-crylamide-co-N-vinyl-2-pyrrolidone-co-N-(3-acetoacetamidopropyl)methacrylamide] (50:45:5).

3. An element as defined in claim 1, wherein said compatible polymer composition comprises poly[N-(2-acetoacetoxyethyl)acrylamide-co-acrylamide-co-N-vinyl-2-pyrrolidone] (5:50:45).

4. An element as defined in claim 1, wherein said compatible polymer composition comprises poly(acrylamide-co-1-vinylimidazole) (90:10).

5. An element as defined in claim 1, wherein said compatible polymer composition comprises poly(acrylamide-co-N-vinyl-2-pyrrolidone-co-2-acetoacetoxyethyl methacrylate) (50:45:5).

6. An element as defined in claim 1, wherein said compatible polymer composition comprises poly(acrylamide-co-N-vinyl-2-pyrrolidone-co-ethyl acryloylacetate) (50:45:5).

7. In an imaging element including a support and a radiation-responsive, image-forming composition capable of imagewise-converting an aromatic dialdehyde into a dye, said composition including said dialdehyde and comprising at least one layer on said support, the improvement comprising a compatible layer of poly(acrylamide-CO-N-vinyl-2-pyrrolidone-co-2-hydroxyethyl acrylate) (45:45:10) superimposed over said at least one layer.

8. An element as defined in claim 1, wherein said compatible polymer composition comprises poly(acrylamide-co-ethyl-acrylate-co-N-methylolacrylamide) (65:25:10).

9. An element as defined in claim 1, wherein said compatible polymer composition comprises poly(acrylamide-co-N-vinyl-2-pyrrolidone) (90:10).

10. An element as defined in claim 1, wherein said dialdehyde is ortho-phthalaldehyde.

11. In an imaging element including a support and a radiation-responsive image-forming composition capable of imagewise-converting ortho-phthalaldehyde into a dye, said composition including said phthalaldehyde and comprising at least one layer on said support, the improvement wherein a compatible layer comprising gelatin is superimposed over said composition.

12. In an imaging element including a support and a radiation-responsive, image-forming composition capable of imagewise-converting an aromatic dialdehyde into a dye, said composition including said dialdehyde and comprising at least one layer on said support, the improvement comprising a compatible layer superimposed over said composition and comprising a polymer having recurring units of the formula:

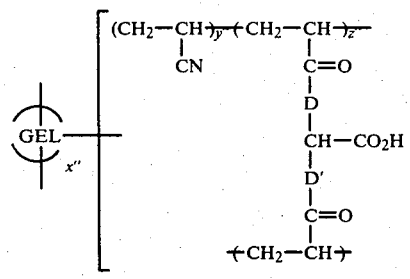

wherein

GEL is gelatin,

D and D' are the same or different and each is —NH— or —O—, and x'', y'', and z'' are weight percents of the recurring units, totalling 100, such that $50 \leqq x'' \leqq 90$, $10 \leqq y'' \leqq 50$, and $0 \leqq z'' \leqq 10$

13. An element as defined in claim 12, wherein said compatible polymer composition comprises gelatin grafted with poly[acrylonitrile-co-bis(acrylamido)acetic acid] (45:50:5).

14. An element as defined in claim 12, wherein said compatible polymer composition comprises gelatin grafted with poly[acrylonitrile-co-bis(acrylamido)acetic acid] (70:25:5).

15. In an imaging element including a support and a radiation-responsive, image-forming composition capable of imagewise-converting an aromatic dialdehyde into a dye, said composition including said dialdehyde and comprising at least one layer on said support, the improvement comprising a compatible layer superimposed over said composition and comprising gelatin grafted with recurring units of acrylonitrile and bisacrylamidoacetic acid.

16. In an imaging element including a support and a radiation-responsive, image-forming composition capable of imagewise-converting an aromatic dialdehyde into a dye, said composition including said dialdehyde and comprising at least one layer on said support, the improvement comprising a compatible layer superimposed over said composition and comprising poly(N-vinyl-2-pyrrolidone) coated with poly(vinyl alcohol) hydrolyzed to at least about 99.7%.

* * * * *

UNITED STATES PATENT AND TRADEMARK OFFICE

CERTIFICATE OF CORRECTION

PATENT NO. 4,288,531

DATED September 8, 1981

INVENTOR(S) Anthony Adin, Richard C. Sutton and Joseph A. Verdone

It is certified that error appears in the above-identified patent and that said Letters Patent are hereby corrected as shown below Col. 14, line 51 reading " $50 \leqq X \leqq 90$, "
should read -- $50 \leqq x \leqq 90$, --.

Col. 16, line 5, the structure should read as follows:

--

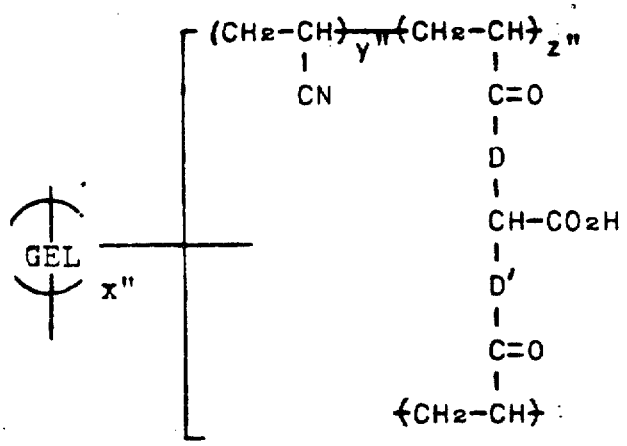

--

Signed and Sealed this

Tenth Day of May 1983

[SEAL]

Attest:

GERALD J. MOSSINGHOFF

Attesting Officer

Commissioner of Patents and Trademarks